US006605573B1

(12) United States Patent
Koganei et al.

(10) Patent No.: US 6,605,573 B1
(45) Date of Patent: Aug. 12, 2003

(54) LUBRICATING OIL COMPOSITION FOR INTERNAL COMBUSTION ENGINES (LAW651)

(76) Inventors: Katsuya Koganei, 4-4, Nishitsurugaoka 1-Chome, Ohi-Machi, Iruma-Gun, Saitama-Ken (JP), 356; Makoto Kanbara, 2-7, Minamimaioka 2-Chome, Totsuka-Ku, Yokohama-Shi, Kanagawa-Ken (JP), 244

( * ) Notice: Subject to any disclaimer, the term of this patent is extended or adjusted under 35 U.S.C. 154(b) by 494 days.

(21) Appl. No.: 08/987,404

(22) Filed: Dec. 9, 1997

(30) Foreign Application Priority Data

Dec. 27, 1996 (JP) ..... 96-359019

(51) Int. Cl.[7] ..... C10M 141/06; C10M 141/10
(52) U.S. Cl. ..... 508/376; 508/485; 208/18
(58) Field of Search ..... 508/376, 485; 208/18

(56) References Cited

U.S. PATENT DOCUMENTS

| | | | | | |
|---|---|---|---|---|---|
| 4,175,047 | A | | 11/1979 | Schick et al. | 252/56 S |
| 4,479,883 | A | | 10/1984 | Shaub et al. | 252/32.7 E |
| 4,648,985 | A | * | 3/1987 | Thorsell et al. | 508/376 |
| 4,968,452 | A | * | 11/1990 | Seiki | 508/485 |
| 5,151,205 | A | * | 9/1992 | Culpon, Jr. | 508/485 |
| 5,273,672 | A | * | 12/1993 | Dasai et al. | 508/485 |
| 5,364,545 | A | * | 11/1994 | Arai et al. | 508/376 |
| 5,629,272 | A | * | 5/1997 | Nakazato et al. | 508/376 |
| 5,641,731 | A | | 6/1997 | Baumgart et al. | 508/183 |
| 5,665,683 | A | | 9/1997 | Froeschmann | 508/271 |
| 5,744,430 | A | * | 4/1998 | Inoile et al. | 508/376 |

FOREIGN PATENT DOCUMENTS

| | | | |
|---|---|---|---|
| JP | 01079299 | 3/1989 | C10M/169/04 |
| JP | 08183985 | 7/1996 | C10M/169/04 |

OTHER PUBLICATIONS

Abstract JP–100879 (English Abstract) Apr. 12, 1994.*
Abstract JP–113,604 (English Abstract) Sep. 5, 1979.*
Abstract JP–6392 (English Abstract) Feb. 14, 1974.*

* cited by examiner

*Primary Examiner*—Margaret Medley

(57) ABSTRACT

A synthetic lubricating oil composition for internal combustion engines, comprises an organomolybdenum compound, a zinc dithiophosphate and a base stock obtained by blending an ester having a kinematic viscosity of from 8 cSt to 35 cSt at 100° C. and a saponification value of 200 mg-KOH/g or smaller with a poly (α-olefin) and/or a highly-refined mineral oil.

7 Claims, No Drawings

LUBRICATING OIL COMPOSITION FOR INTERNAL COMBUSTION ENGINES (LAW651)

FIELD OF THE INVENTION

This invention relates to a lubricating oil composition for internal combustion engines, and more specifically to an ester-blended lubricating oil composition for internal combustion engines, which makes use of a blended base stock composed of an ester and a poly (α-olefin) and/or a highly-refined mineral oil and allows a molybdenum-containing friction modifier to show its effects to maximum extent.

DESCRIPTION OF THE PRIOR ART

For a lubricating oil for internal combustion engines of automotive vehicles or the like, which may hereinafter be called the "engine oil", diversified performance is required such as cooling of an inside of an engine, cleaning and dispersion of combustion products, and also prevention of rusting and corrosion in addition to lubrication of piston rings and a cylinder lining, bearings for a crankshaft and connecting rod, and a valve-operating mechanism including cams and valve lifters.

Moreover, keeping in step with the recent move toward internal combustion engines of higher performance and higher output for automotive vehicles, sliding parts are exposed to ever increasing more severe friction and abrasion conditions at high temperatures, leading to a demand for a lubricating oil capable of withstanding such extremely severe conditions. With a view to meeting this demand, synthetic lubricating oils making use of highly-refined mineral oils and ester base stocks and/or synthetic hydrocarbon base stocks excellent in oxidation stability, cleaning and dispersing properties and the like have been proposed as substitutes for conventional mineral oils. To cope with energy and environmental problems, however, it is indispensable for an engine oil to have fuel consumption saving ability. It has therefore become extremely important for such engine oil to also have a small friction loss in an internal combustion engine. For the reduction of frictional loss, friction modifiers hence are being increasingly used. Organomolybdenum compounds, for example, molybdenum dialkyldithiocarbamates (MoDTC), oxymolybdenum diethylate amides and the like have been proposed [see Japanese Patent Publication (Kokoku) No. SHO 49-6392, Japanese Patent Application Laid-Open (Kokai) No. SHO 54-113604, Japanese Patent Application Laid-Open (Kokai) No. HEI 6-100879, etc.].

However, molybdenum-base friction modifiers carry with them the problems that they show extremely low friction reducing effects when used in combination with ester-blended base stocks and that the effects of molybdenum-base friction modifiers are substantially reduced in the presence of a phosphorus component such as a zinc dithiophosphate, especially in the presence of such a phosphorus component at a high concentration.

As has been explained above, there is a significant obstacle involved with the use of ester-blended base stocks as lubricating oils for internal combustion engines, said lubricating oils being required to have friction reducing effects, although they are excellent in oxidation stability, cleaning and dispersion ability and the like.

An object of the present invention is therefore to provide a fuel-consumption-saving, synthetic lubricating oil composition of a low coefficient of friction, which allows a molybdenum-base friction modifier to show its friction reducing effects to maximum extent in an ester-blended base stock.

SUMMARY OF THE INVENTION

In view of the status of developments of fuel-consumption-saving lubricating oils as described above, the present inventors have proceeded with an extensive investigation. As a result, it has been found that use of a synthetic ester base stock of particular properties as a component of a lubricating oil composition makes it possible to highly exhibit the friction reducing effects of a molybdenum-base friction modifier. Based on this finding, the present invention has now been completed.

The present invention relates to a lubricating oil composition for internal combustion engines, said composition containing an ester-blended base stock, an organomolybdenum compound and a zinc dithiophosphate, wherein said ester-blended base stock comprises:

an ester having a kinematic viscosity of from 8 cSt to 35 cSt at 100° C. and a saponification value of 200 mg-KOH/g or lower; and a poly (α-olefin) and/or a highly-refined mineral oil.

Preferably, the present invention relates to a lubricating oil composition for internal combustion engines, comprising:

a base stock composed of a blend of:

at least one ester selected from the group consisting of diesters and polyol esters, each of which has a kinematic viscosity of from about 8 cSt to 35 cSt at 100° C. and a saponification value of from 80 mg-KOH/g to 200 mg-KOH/g, and a poly (α-olefin) obtained by low-degree polymerization of an α-olefin and/or a highly-refined mineral oil having a sulfur content of 5 ppm or lower and an aromatic hydrocarbon content of 1 wt % or lower; and based on the whole weight of said lubricating oil composition, 100 ppm to 1,000 ppm, in terms of molybdenum, of a molybdenum dithiocarbamate; and 800 ppm to 1,800 ppm, in terms of phosphorus, of a zinc dithiophosphate.

More preferably, the present invention relates to a lubricating oil composition for internal combustion engines, comprising:

a blended base stock composed of:

10 wt % to 30 wt % of an ester base stock having a kinematic viscosity of from 8 cSt to 35 cSt at 100° C. and a saponification value of from 80 mg-KOH/g to 200 mg-KOH/g, and 90 wt % to 70 wt % of a poly (α-olefin) base stock or a highly-refined mineral base stock;

100 ppm to 1,000 ppm, in terms of molybdenum, of a molybdenum dithiocarbamate; and 800 ppm to 1,800 ppm, in terms of phosphorus, of a zinc dithiophosphate.

DETAILED DESCRIPTION OF THE INVENTION

Unique features of the present invention reside in the use of (i) an organic acid ester as a base stock in the lubricating oil composition for internal combustion engines and further in the selection and use, as the organic acid ester, of an organic ester having (ii) a saponification value of 200 mg-KOH/g or lower and (iii) a kinematic viscosity of at least 8 cSt at 100° C. The present inventors have found for the first time that the use of an organic acid ester having a saponification value and a viscosity in these ranges as a base stock in a lubricating oil composition for internal combustion engines makes it possible to fully exhibit the performance of a molybdenum-base friction modifier.

The ester useful as a component of the lubrication oil composition according to the present invention for internal combustion engines is selected from organic acid esters, for example, from the group consisting of diesters including dimer acid esters, polyol esters and complex esters, said esters having a kinematic viscosity of from 8 cSt to 35 cSt at 100° C. and a saponification value of 200 mg-KOH/g or lower.

Preferred examples of diesters usable in the lubricating oil composition of the present invention for internal combustion engines are diesters in which the total number of carbon atoms is 38 or greater. No particular limitation is imposed on the diesters, insofar as their total carbon numbers as defined above are 38 or greater and they are available through esterification reactions between dibasic acids and alcohols. Those obtained by bonding between aliphatic dibasic acids having 4 to 40 carbon atoms and alcohols having 4 to 24 carbon atoms can be used. Preferred examples of aliphatic dibasic acids having 4 to 40 carbon atoms can include succinic acid, glutaric acid, adipic acid, pimelic acid, suberic acid, azelaic acid, sebacic acid, undecanoic diacid, dodecanoic diacid, tridecanoic diacid, and dimer acids. Dimer acids are typically identified in the trade as dicarboxylic acids usually containing about 36 carbons. Among alcohols having 4 to 24 carbon atoms, preferred examples can include n-butanol, isobutanol, n-pentanol, isopentanol, n-hexanol, 2-ethylbutanol, cyclohexanol, n-heptanol, isoheptanol, methylcyclohexanol, n-octanol, dimethylhexanol, 2-ethylhexanol, 2,4,4-trimethylpentanol, isooctanol, 3,5,5-trimethylhexanol, isononanol, isodecanol, isoundecanol, 2-butyloctanol, tridecanol, isotetradecanol, isopentadeccanol, isohexadecanol, isohepta-decanol, isooctadecanol, isononadecanol, isoeicosanol, and isotricosanol. Also usable are their dialcohols and diols of polyalkylene glycols.

As organic acid esters of another type usable as base stocks in the lubricating oil composition of this invention for internal combustion engines, polyol esters can be mentioned. These polyol esters are synthetically prepared from a neopentyl polyol having 5 to 10 carbon atoms and an organic acid having 4 to 24 carbon atoms. The term "neopentyl polyol" as used herein means a polyhydric alcohol having a neopentyl group. Illustrative are 2,2-dimethylpropane-1,3-diol, (namely, neopentyl glycol), 2-ethyl-2-butylpropane-1,3-diol, 2,2-diethylpropane-1,3-diol, 2,2-dibutylpropane-1,3-diol, 2-methyl-2-propylpropane-1,3-diol, trimethylolpropane, pentaerythritol and dipentaerythritol. Preferred are neopentylglycol, 2-methyl-2 peopylpropane-1,3-diol, trimethylolpropane and pentaerythritol, with trimethylolpropane and pentaerythritol being particularly preferred.

Examples of the organic acid can include butanoic acid, isobutanoic acid, pentanoic acid, isopentanoic acid, hexanoic acid, 2-ethylbutanoic acid, cyclohexanoic acid, heptanoic acid, isoheptanoic acid, methylcyclohexanoic acid, octanoic acid, dimethyl-hexanoic acid, 2-ethylhexanoic acid, 2,4,4-trimethyl-pentanoic acid, isooctanoic acid, 3,5,5-trimethylhexanoic acid, nonanoic acid, isononanoic acid, isodecanoic acid, isoundecanoic acid, 2-butyloctanoic acid, tridecanoic acid, tetradecanoic acid, hexadecanoic acid, heptadecanoic acid, octadecanoic acid, 2-ethylhexadecanoic acid, nonadecanoic acid, 2-methyloctadecanoic acid, icosanoic acid, 2-methylicosanoic acid, 3-methylnonadecanoic acid, docosanoic acid, tetradocosanoic acid, 2-methyltricosanoic acid, and oleic acid.

A preferred trimethylolpropane ester is one having 54 or more carbon atoms as the total number of carbon atoms in its acid and alcohol, and a preferred pentaerythritol ester is one having 77 or more carbon atoms as the total number of carbon atoms in its acid and alcohol.

The synthesis of a neopentyl polyol ester from an organic acid and a neopentyl polyol can be performed by a method known per se in the art, for example, by subjecting them to dehydrating condensation in the presence of an acid catalyst.

For use in the present invention, the above-described diesters and polyol esters possess a kinematic viscosity range of from 8 cSt to 35 cSt. A kinematic viscosity range of from 8 cSt to 24 cSt is preferred.

An ester base stock, the kinematic viscosity of which does not reach 8 cSt at 100° C., has been found impossible to provide sufficient friction reducing effects even if its saponification value is 200 mg-KOH/g or lower.

Further, the ester base stock has a saponification value of 200 mg-KOH/g or lower, preferably of from 80 mg-KOH/g to 200 mg-KOH/g. A saponification value higher than 200 mg-KOH/g cannot exhibit the friction reduction effects of the molybdenum-base friction modifier, so that the coefficient of friction is not lowered sufficiently. On the other hand, a saponification value lower than 80 mg-KOH/g leads to an increase in the coefficient of friction at a high oil temperature, thereby making it difficult to achieve the object, namely, a saving in fuel consumption.

The term "saponification value" as used herein means a value measured in accordance with the saponification value testing method specified under K2503 of the Japanese Industrial Standard (JIS).

The poly (α-olefin) base stock which can be employed as another component in the lubricating oil composition of the present invention for internal oil combustion engines is an α-olefin oligomer which is available by low-degree polymerization of an α-olefin containing a double bond at an end thereof as a raw material. A suitable example of the poly ((α-olefin) is a polymer which is in a liquid form in an ordinary state and is available by decomposition of a wax or by low-degree polymerization of a lower olefin, specifically by copolymerization of an α-olefin mixture having 6–14 carbon atoms and available by trimerization to dodecamerization of such a lower olefin. Usable examples of the α-olefin mixture can include those containing 25 wt % to 50 wt % of hexene-1, 30 wt % to 40 wt % of octene 1, and 25 wt % to 40 wt % of decene-1. Also preferred are poly (α-olefins) each of which is available by polymerizing, as a raw material, a single monomer such as an α-olefin having 10 carbon atoms, specifically decene-1. Such poly (α-olefin) base stock possesses a kinematic viscosity of from 3 cSt to 20 cSt at 100° C. A kinematic viscosity of from 4 cSt to 10 cSt at 100° C is preferred.

The highly-refined mineral oil which can be employed as a base stock in the lubricating oil composition of this invention for internal combustion engines has a kinematic viscosity of from 3 cSt to 20 cSt, preferably from 4 cSt to 10 cSt at 100° C., a sulfur content of 5 ppm or lower, preferably 2 ppm or lower, and an aromatic hydrocarbon content of 1 wt % or lower, preferably 0.5 wt % or lower.

Any process can be used for the preparation of the above-described highly-refined mineral oil. For example, a highly-refined mineral oil, especially a highly hydro-refined oil can be obtained specifically by subjecting lubricating oil fractions, which are derived from a paraffin-base crude oil or a neutral crude oil by atmosphere distillation or vacuum distillation, to hydro-refining or hydrocracking and then treating the resulting oil by a lubricating oil refining method such as solvent extraction, solvent dewaxing or catalytic dewaxing, or clay treatment. Selection of reaction conditions for hydro-refining or hydrocracking makes it possible to obtain a highly-refined mineral oil with its sulfur content and aromatic hydrocarbon content set in the above-described specific ranges.

The aromatic hydrocarbon content and naphthenic hydrocarbon content in the highly-refined mineral oil were measured by the n-d-M method specified under ASTM-D3238.

The blended base stock in the present invention is (1) a blend of an ester base stock with a poly (α-olefin) base stock or a highly-refined mineral oil, or (2) a blend of an ester base stock, a poly (α-olefin) base stock and a highly-refined mineral oil. Hereinafter the phrase poly (α-olefin) base stock and/or highly refined mineral oil is meant to embrace the use of either such base stock individually with the aforesaid ester base stock or the use of both the poly (α-olefin) and mineral oil in combination with the ester base stock. The blended base stock contains, based on the whole weight of the base stock, 10 wt % to 30 wt % of the above-described ester and 30 wt % to 70 wt % of the poly (α-olefin) and/or the highly-purified mineral oil. An ester content lower than 10 wt % carries with it a potential problem that the coefficient of friction may increase at high temperatures, and on the other hand, an ester content higher than 30 wt % tends to cause a problem such that the friction reducing effect of the organomolybdenum compound may be impaired.

Further, the saponification value of the blended base stock of the ester with the poly (α-olefin) and/or the highly-refined mineral oil may preferably fall within a range of from 10 mg-KOH/g to 60 mg-KOH/g.

Examples of the organomolybdenum compound employed in the lubricating oil composition of the present invention for internal combustion engines can include molybdenum dithiophosphates (MoDTP), molybdenum dithiocarbamates (MoDTC), and oxymolybdenum ethylate amides. Preferred are molybdenum dithiocarbamates (MoDTC), which can be represented, for example, by the following formula [I]:

[I]

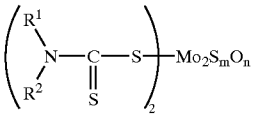

In the above formula [I], $R^1$ and $R^2$ are hydrocarbon groups having 1 to 30 carbon atoms and may be the same or different. Further, m and n are integers of 0 or greater and wherein the sum of m+n is 4. As the hydrocarbon groups, linear or branched alkyl groups are preferred. The content of such an organomolybdenum compound is in a range of from 100 ppm to 1,000 ppm, preferably from 400 ppm to 900 ppm in terms of molybdenum based on the whole weight of the lubricating oil composition, within which its performance can be exhibited to maximum extent. If the content does not reach 100 ppm, the friction reducing effect is not sufficient. On the other hand, even if the content exceeds 1,000 ppm, the friction reducing effect is not available to such an extent as corresponding to the increased content.

Zinc dithiophosphates usable in the lubricating oil composition of the present invention for internal combustion engines are represented by the following formula [II]:

[II]

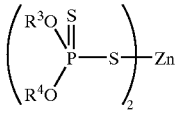

In the formula, $R^3$ and $R^4$ are hydrocarbon groups having 3 to 20 carbon atoms, and may be the same or different. Usually, zinc dithiophosphates in each of which $R^3$ and $R^4$ are the same can be used either singly or in combination. As the hydrocarbon groups, alkyl groups are preferred.

The content of the zinc dithiophosphate can be in a range of from 800 ppm to 1,800 ppm, preferably 900 ppm to 1,500 ppm in terms of phosphorus based on the whole weight of the lubricating oil composition.

According to the present invention, the friction reducing effect is not impaired even if the concentration of phosphorus is increased, so that the zinc dithiophosphate can be used in an effective amount as much as needed. This has made it possible to provide a lubricating oil composition offering performance in both wear resistance and friction reduction.

To the lubricating oil composition according to the present invention, a metallic detergent can be added further as desired. As the metallic detergent, an overbased salt having a total base number of 150 mg-KOH/g is suited. Illustrative of the overbased salt are the phenates, salicylates and sulfonates of alkaline earth metals, including, as specific examples, calcium phenate, calcium salicylate, calcium sulfonate, magnesium phenate, magnesium salicylate, magnesium sulfonate, barium phenate, barium salicylate, and barium sulfonate. Of these, calcium sulfonate and calcium salicylate are particularly suited.

These metallic detergents can be used in an amount of from 0.1 wt % to 5 wt % in terms of the metal, for example, calcium, based on the whole weight of the lubricating oil composition.

To the lubricating oil composition according to the present invention, it is possible to add various other additives insofar as the advantageous effects of the present invention are not impaired. It is possible to add additives effective for imparting improved properties and performance required for lubricating oils for internal combustion engines, for example, viscosity index improvers, pour-point depressants, oxidation inhibitors, ashless dispersants, wear inhibitors, rust preventives, and the like.

Illustrative examples of the viscosity index improvers can include polymethacrylates, polyisobutylenes, ethylene-propylene copolymers, and hydrogenated styrene-butadiene copolymers. The lubricating oil composition of the present invention for internal combustion engines has good viscosity characteristics by itself so that the addition of a viscosity index improver is not absolutely needed. Nonetheless, a viscosity index improver can be added as desired. When used in racing engines, however, it should be added in an amount smaller than a usual amount, for example, in an amount of 10 wt % or less, preferably 7 wt % or less, more preferably 5 wt % or less to suppress coking.

Illustrative examples of the oxidation inhibitors include amine-type oxidation inhibitors such as alkylated diphenylamines, phenyl-α-naphthylamines and alkylated α-naphthylamines; hindered phenolic oxidation inhibitors such as 2,6-di-t-butylphenol, 2,6-di-t-butylparacresol and 4,4'-methylenebis (2,6-di-t-butyl-phenol); phosphorus-containing oxidation inhibitors; and sulfur-containing oxidation inhibitors such as monosulfides and polysulfides. They can be used normally in a proportion of from 0.05 wt % to 2 wt %.

Illustrative examples of the ashless dispersants include polyalkenyl-succinimides and boron-containing polyalkenylsucccinimides. They can be used in a proportion of from 1 wt % to 10 wt %.

The present invention has been described in detail above. As preferred embodiments of the present invention, synthetic lubricating oil compositions for internal combustion engines, said compositions being of the following formulas and properties, can be furnished.

| | |
|---|---|
| Base stock | |
| -($C_{16}$—$C_{18}$) Aliphatic acid trimethylolpropane ester<br>Kinematic viscosity at 100° C.: 10-cSt to 15 cSt<br>Saponification value: 100 mg-KOH/g to 150 mg-KOH/g | 15 wt % to 25 wt % |
| -Poly (α-olefin)<br>Kinematic viscosity at 100° C.: 4 cSt to 6 cSt | 85 wt % to 75 wt % |
| Additives | |
| Molybdenum di (2-ethylhexyl) dithiocarbamate ($C_8$MoDTC): | 0.8 wt % to 1.2 wt % |
| Zinc di (secondary $C_3$—$C_6$ alkyl) dithiophosphate (2ryZnDTP): | 1 wt % to 2 wt % |
| Boron-containing polybutylenylsucccinimide: | 0.01 wt % to 1 wt % |
| Over-based calcium salicylate: | 0.1 wt % to 5 wt % |
| 2,6-Di-t-butylcresol: | 0.05 wt % to 2 wt % |
| Polymethacrylate: | 0.05 wt % to 7 wt % |
| Silicone: | 0.001 wt % to 0.004 wt % |

Lubricating oil compositions of this invention for internal combustion engines, which have been prepared as described above, can withstand particularly severe use conditions and are hence suited for racing cars.

EXAMPLES

The present invention will next be described by Examples and Comparative Examples.

The following are measuring methods of characteristic values.

(1) Saponification Value [JIS K2503 (Indicator Titration Method)]

Saponification value represents a mass (mg) of potassium hydroxide required to saponify 1 g of a sample, and is measured by the following method.

2-Butanone is added to a sample to dissolve the sample. A known-amount of a solution of potassium hydroxide in ethanol is next added, followed by heating under reflux to achieve saponification. The resultant mixture is titrated with a standard hydrochloric acid solution to determine an amount of consumed potassium hydroxide. The saponification value of the sample is then calculated. The calculation is performed in accordance with the following formula:

$$S = \frac{56.1C(V_1 - V_2)}{W} \quad \text{[III]}$$

where,

S: Saponification value (mg-KOH/g)

$V_1$: Amount of HCl solution required for blank determination (ml)

$V_2$: Amount of HCl solution required in the titration of the sample (ml)

C: Molar concentration of HCl solution (mol/l)

W: Weighed amount of the sample (g)

(2) SRV Friction Coefficient

A friction coefficient is measured under the following reaction conditions by using a reciprocating friction tester.

| Testing conditions | |
|---|---|
| Load, N | 400 |
| Oil temperature, ° C. | 40° C., 80° C., 120° C. |
| Frequency, Hz | 50 |
| Amplitude, mm | 1.5 |
| Time, min | 5 to 10 |

Example 1

A blended base stock was prepared consisting of 80 wt % of a poly (α-olefin) having a kinematic viscosity of 4 cSt at 100° C. and 20 wt % of a $C_8$ alcohol-dimer acid ester having a kinematic viscosity of 13.2 cSt at 100° C. and a saponification value of 142 mg-KOH/g. The blended base stock had a kinematic viscosity of 4.8 cSt at 100° C. and a saponification value of 28.4 mg-KOH/g. To the blended base stock, 1.2 wt % of molybdenum di(2-ethylhexyl) dithiocarbamate ($C_8$MoDTC) and 1.5 wt % of zinc di(secondary iso-$C_3$/iso-$C_6$) dithiophosphate were added based on the whole weight of a lubricating oil composition. Further, a boron-containing succinimide (ashless cleaning dispersant), over-based calcium salicylate (metallic detergent), 2,6-di-t-butylphenol (oxidation inhibitor), a polymethacrylate (dispersion-type viscosity index improver) and a silicone (antifoaming agent) were added as shown in Table 1, whereby the lubricating oil composition was prepared. The SRV friction coefficient of the lubricating oil composition was measured. The results presented in Table 1 were obtained.

Example 2

A lubricating oil composition was prepared in a similar manner as in Example 1 except for the use $C_{18}$ trimethylolpropane ester ($C_{18}$TMP) in place of the $C_8$ alcohol-dimer acid ester. The blended base stock had a kinematic viscosity of 4.8 cSt at 100° C. and a saponification value of 36 mg-KOH/g. Measurement results of the SRV friction coefficient of the lubricating base stock are presented in Table 1.

Comparative Example 1

Blended were 53 wt % of a poly (α-olefin) having a kinematic viscosity of 4 cSt at 100° C. and 47 wt % of a poly (α-olefin) having a kinematic viscosity of 6 cSt at 100° C., whereby the kinematic viscosity of a blended base stock was adjusted to 4.8 cSt at 100° C. The kinds and amounts of the additives were exactly the same as in Example 1. Measurement results of the SRV friction coefficient of the lubricating oil composition are presented in Table 1. The friction coefficient at a high temperature (120° C.) is large, thereby indicating that use of one or more poly (α-olefins) alone has a drawback in high-temperature friction characteristics.

Comparative Example 2

Blended into a base stock having a kinematic viscosity of 4.8 cSt at 100° C. were 85 wt % of a poly (α-olefin) having a kinematic viscosity of 4 cSt at 100° C. and 15 wt % of a poly (α-olefin) having a kinematic viscosity of 20 cSt at 100° C. The kinds and amounts of the additives were the same as in Example 1. Measurement results of the SRV friction coefficient are presented in Table 1.

Comparative Example 3

To a base stock having a kinematic viscosity of 4.8 cSt at 100° C. and obtained by blending 44 wt % of a poly (α-olefin) having a kinematic viscosity of 4 cSt at 100° C., 39 wt % of a poly (α-olefin) having a kinematic viscosity of 8 cSt at 100° C. and 17 wt % of dioctyl sebacate together, the additives shown in Table 1 were added in the respective proportions also shown in the same table.

Comparative Examples 4–7

Two types of poly (α-olefins), which had kinematic viscosities of 4 cSt and 6 cSt at 100° C., respectively, were blended in the proportions shown in Table 1, to which the $C_8$ acid-trimethylolpropane ester ($C_8$TMP) was then blended in the proportions shown in the same table to prepare blended base stocks having a kinematic viscosity of 4.8 cSt at 100° C. In the respective Comparative Examples, the additives were the same in both kinds and amounts. The $C_8$ acid-trimethylolpropane esters added to the base stocks prepared in Comparative Examples 4–7 all had a saponification value of 328 mg-KOH/g. Measurement results of their SRV friction coefficients are presented in Table 1.

Comparative Example 8

As is shown in Table 1, 15 wt % of a poly (α-olefin) having a kinematic viscosity of 4 cSt at 100° C., 65 wt % of a poly (α-olefin) having a kinematic viscosity of 6 cSt and 20 wt % of a $C_{18}$ acid-$C_8$ alcohol monoester were blended to prepare a blended base stock having a kinematic viscosity of 4.8 cSt at 100° C. To the blended base stock, the same additives as in Example 1 were added in the respective proportions presented in the same table.

As is seen from the above Examples and Comparative Examples, the use of an ester base stock having a kinematic viscosity of 8 cSt or higher and a saponification value of 200 mg-KOH/g or lower makes it possible to obtain a synthetic lubricating oil composition having high friction reducing effect. (Table 1 )

According to the invention, the use of a blended base stock of an ester with a poly (α-olefin) and/or a highly-refined mineral oil, said ester having a kinematic viscosity of 8 cSt or higher at 100° C. and a saponification value of 200 mg-KOH/g or smaller, makes it possible to exhibit the friction reducing effect of a molybdenum-base friction modifier to maximum extent and hence to provide a lubricating oil composition with a significantly lowered friction coefficient. In particular, the blended base stock can fully exhibit the friction reducing effect in a high-phosphorus oil.

TABLE 1

| | Ex. 1 | Ex. 2 | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|---|---|
| Properties of base stock | | | | | | | | | | |
| Kinematic viscosity of ester base | 13.2 | 13.0 | — | — | 3.2 | 4.5 | 4.5 | 4.5 | 4.5 | 3.1 |
| stock (cSt, at 100° C.) | 142 | 180 | 0 | 0 | 261 | 328 | 328 | 328 | 328 | 141 |
| Saponification value of ester base | 4.8 | 4.8 | 4.8 | 4.8 | 4.8 | 4.8 | 4.8 | 4.8 | 4.8 | 4.8 |
| stock (mg-KOH/g) | 28.4 | 36 | 0 | 0 | 44.5 | 29.5 | 65.6 | 131.2 | 196.8 | 28.2 |
| Kinematic viscosity of blended base stock (cSt, at 100° C.) | | | | | | | | | | |
| Saponification value of blended base stock (mg-KOH/g) | | | | | | | | | | |
| Base stock formula | | | | | | | | | | |
| PAO - 4 cSt at 100° C. | 80 | 80 | 53 | 85 | 44 | 45 | 38 | 25 | 12 | 15 |
| PAO - 6 cSt at 100° C. | | | 47 | | | 46 | 42 | 35 | 28 | 65 |
| PAO - 8 cSt at 100° C. | | | | | 39 | | | | | |
| PAO - 20 cSt at 100° C. | | | | 15 | | | | | | |
| Dioctyl sebacate | | | | | 17 | | | | | |
| $C_8$ acid-TMP ester | | | | | | 9 | 20 | 40 | 60 | |
| $C_8$ alcohol-dimer acid ester | 20 | | | | | | | | | |
| $C_{18}$ acid-TMP ester | | 20 | | | | | | | | |
| $C_{18}$ acid-$C_8$ alcohol monoester | | | | | | | | | | 20 |
| Additives | | | | | | | | | | |
| 2ryZnDTP | 1.5 | 1.5 | 1.5 | 1.5 | 1.5 | 1.5 | 1.5 | 1.5 | 1.5 | 1.5 |
| $C_8$MoDTC | 1.2 | 1.2 | 1.2 | 1.2 | 1.2 | 1.2 | 1.2 | 1.2 | 1.2 | 1.2 |
| Boron-containing succinimide | 5 | 5 | 5 | 5 | 5 | 5 | 5 | 5 | 5 | 5 |
| Over-based calcium salicylate | 4 | 4 | 4 | 4 | 4 | 4 | 4 | 4 | 4 | 4 |
| 2,6-Di-t-butylcresol | 1 | I | 1 | 1 | 1 | 1 | 1 | 1 | 1 | 1 |
| Silicone | 0.002 | 0.002 | 0.002 | 0.002 | 0.002 | 0.002 | 0.002 | 0.002 | 0.002 | 0.002 |
| Polymethacrylate | 1 | 1 | 1 | 1 | 1 | 1 | 1 | 1 | 1 | 1 |
| SRV friction coefficient | | | | | | | | | | |
| 40° C. | 0.050 | 0.052 | 0.062 | 0.051 | 0.050 | 0.052 | 0.056 | 0.070 | 0.077 | 0.051 |
| 80° C. | 0.052 | 0.052 | 0.084 | 0.077 | 0.050 | 0.059 | 0.059 | 0.054 | 0.057 | 0.055 |
| 120° C. | 0.058 | 0.059 | 0.106 | 0.126 | 0.085 | 0.103 | 0.095 | 0.070 | 0.083 | 0.122 |

Note: PAO - Poly (α-olefin); Blended base stock: Blended oil of ester and poly (α-olefin)

What is claimed is:

1. A lubricating oil composition for internal combustion engines, said composition comprising an ester-blended base stock, an organomolybdenum compound and a zinc dithiophosphate, wherein said ester-blended base stock comprises:

from 10 wt. % to 30 wt. % based on the whole weight of the base stock of an ester having a kinematic viscosity of from 8 cSt to 35 cSt at 100° C. and a saponification value of 200 mg-KOH/g or lower; and from 90 wt. % to 70 wt. % based on the whole weight of the base stock of a poly (α-olefin) and/or a highly-refined mineral oil having a sulfur content of 5 ppm or lower and an aromatic hydrocarbon content of 1 wt. % or less.

2. The lubricating oil composition of claim 1 wherein the poly (α-olefin) and/or highly refined mineral oil have a kinematic viscosity at 100° C. of from 3 cSt to 20 cSt.

3. The lubricating oil composition of claim 1 wherein the ester blended base stock comprises at least one ester selected from the group consisting of diesters and polyol ester, each of which has a kinematic viscosity of from about 8 cSt to 35 cSt at 100° C. and a saponification value of from 80 mg-KOH/g to 200 mg-KOH/g, and wherein the poly(α-olefin) is obtained by low-degree polymeregation of an α-olefin.

4. The lubricating oil composition of claim 1, 3 or 8 wherein the organomolybdenum compound is present in an amount in the range of 100 ppm to 1,000 ppm in terms of molybdenum and the zinc dithiophosphate is present in an amount in the range of 800 ppm to 1,800 ppm in terms of phosphorus.

5. The lubricating oil composition of claim 4 wherein the organomolybdenum compound is molybdenum dithio carbamate of the formula

[I]

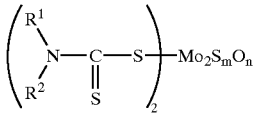

wherein $R^1$ and $R^2$ are the same or different $C_1$ to $C_{30}$ hydrocarbon group and m and n are integers of 0 to 4 but wherein the sum of m+n is 4.

6. The lubricating oil composition of claim 4 wherein the blended base stock of the ester with the poly (α-olefin) and/or highly refined mineral oil has a saponification value in the range of about 10 mg-KOH/g to 60 mg-KOH/g.

7. A method for forming a lubricating oil having a lowered coefficient of friction comprising combining an ester based lubricating oil base stock, an organomolybdenum compound and a zinc dithiophosphate, wherein the ester based lubricating oil basestock is a mixture of a synthetic ester having a kinematic viscosity of from 8 cSt to 35 cSt at 100° C. and a saponification value of 200 mg-KOH/g or less and a poly (α-olefin) and/or a highly refined mineral oil having a sulfur content of 5 ppm or less and an aromatic hydrocarbon content of 1 wt. % or less and wherein said ester comprises 10 to 30 wt. % of said ester based lubricating oil base stock.

* * * * *